US009592545B2

(12) United States Patent
Angerer et al.

(10) Patent No.: US 9,592,545 B2
(45) Date of Patent: Mar. 14, 2017

(54) REAR STOP DEVICE FOR A BENDING MACHINE

(71) Applicant: TRUMPF Maschinen Austria GmbH & Co. KG., Pasching (AT)

(72) Inventors: Gerhard Angerer, Altenberg (AT); Klemens Freudenthaler, Linz (AT); Josef Gaggl, Steyr (AT); Matthias Hoerl, Oberndorf/Tirol (AT); Helmut Theis, Pfarrkirchen (AT); Thomas Weiss, Linz (AT); Manfred Waldherr, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 14/900,423

(22) PCT Filed: Jun. 18, 2014

(86) PCT No.: PCT/AT2014/050136
§ 371 (c)(1),
(2) Date: Feb. 19, 2016

(87) PCT Pub. No.: WO2014/201490
PCT Pub. Date: Dec. 24, 2014

(65) Prior Publication Data

US 2016/0151826 A1 Jun. 2, 2016

(30) Foreign Application Priority Data

Jun. 20, 2013 (AT) ..... A 50404/2013

(51) Int. Cl.
*B21D 43/26* (2006.01)
*B21D 5/02* (2006.01)
*B21D 5/00* (2006.01)

(52) U.S. Cl.
CPC ..... *B21D 43/26* (2013.01); *B21D 5/002* (2013.01); *B21D 5/02* (2013.01)

(58) Field of Classification Search
CPC ..... B21D 5/002; B21D 5/02; B21D 43/105; B21D 43/26
See application file for complete search history.

(56) References Cited

U.S. PATENT DOCUMENTS 4,055,070 A 10/1977 Wingate et al.
6,212,933 B1 4/2001 Aoki
(Continued)

FOREIGN PATENT DOCUMENTS

AT 509 857 A4 12/2011
DE 37 14 855 A1 11/1988
(Continued)

OTHER PUBLICATIONS

International Search Report of PCT/AT2014/050136, mailed Oct. 9, 2014.

*Primary Examiner* — Debra Sullivan
(74) *Attorney, Agent, or Firm* — Collard & Roe, P.C.

(57) ABSTRACT

The invention relates to a rear stop unit (7) with a stop and/or gripping and/or measuring element (10) for positioning a sheet (3) to be machined on a bending press. The stop and/or gripping and/or measuring element (10) is arranged on an adjustable bearing arm (13) by means of a pivot joint (12). The bearing arm (13) is connected to a guide rail (20) by means of an additional pivot joint (18) via a guide element (19). The rear stop unit (7) further comprises a support arm (21) which is connected to the bearing arm (13) via a joint (22) and to an additional guide element (24) via a rigid connection, and the support arm is connected to the guide rail (20) via the additional guide element. Furthermore, the joint (22) is designed as a rotational/prismatic joint. The position of the bearing arm (13) can thereby be adjusted by
(Continued)

moving the support arm (21) in a linear manner along a guide direction (11) specified by the guide rail (20).

15 Claims, 3 Drawing Sheets

(56) References Cited

U.S. PATENT DOCUMENTS

| | | | |
|---|---|---|---|
| 6,722,178 | B1 | 4/2004 | Ito et al. |
| 6,922,903 | B2 | 8/2005 | Horn |
| 8,833,131 | B2 | 9/2014 | Reiter et al. |
| 2005/0097940 | A1 | 5/2005 | Strasser et al. |
| 2013/0160508 | A1 | 6/2013 | Fischereder et al. |
| 2013/0327104 | A1 | 12/2013 | Haselboeck |

FOREIGN PATENT DOCUMENTS

| | | | |
|---|---|---|---|
| DE | 101 63 956 | A1 | 7/2003 |
| DE | 697 22 935 | T2 | 12/2003 |
| EP | 1 398 094 | A1 | 3/2004 |
| EP | 1 987 899 | A1 | 11/2008 |
| WO | 2012/103565 | A1 | 8/2012 |
| WO | 2012/151601 | A1 | 11/2012 |

REAR STOP DEVICE FOR A BENDING MACHINE

CROSS REFERENCE TO RELATED APPLICATION

This application is the National Stage of PCT/AT2014/050136 filed on Jun. 18, 2014, which claims priority under 35 U.S.C. §119 of Austrian Application No. A 50404/2013 filed on Jun. 20, 2013, the disclosures of which are incorporated by reference. The international application under PCT article 21(2) was not published in English.

BACKGROUND OF THE INVENTION

1. Field of the Invention

The invention relates to a rear stop device comprising a stop and/or gripping and/or measuring element.

2. The Prior Art

Generic rear stop devices, in particular with linear guides, are known from the prior art in a plurality of embodiments.

DE 697 22 935 T2 discloses a rear stop device, which is structured on the basis of a shearing lifting unit. Here two horizontally aligned stop fingers are arranged on a common guide rail running in a direction parallel to the sheet metal bending line, and can be displaced individually in this direction thereby. Said common guide rail is mounted on the shearing lifting units by two rods guided on the upper sides of the shearing lifting unit. By means of the connection of the two upper sides of the shearing lifting unit to a common guiding rod, on which the guide rail is mounted, it is ensured that the guide rail and the stop fingers attached onto the latter always maintain their horizontal alignment, even with a change in position height, and cannot be moved arbitrarily relative to their horizontal alignment. Two guiding elements are attached onto the lower side of the two sides of the shearing lifting unit which guiding elements can be moved in horizontal guide rails along the longitudinal direction of the guide rails, in order to achieve a height adjustment of the stop fingers. The described guide rails are partly designed as spindles in order to achieve the desire height adjustment by adjusting the guiding elements relative to one another. The described rear stop device is arranged directly on the machine frame of a bending machine. The stop section of said rear stop device, which is designed as a shearing hub, is thus limited to the half of the shearing lifting unit facing the bending press, as the stop finger cannot adopt a position in which it can be positioned on the side of the shearing lifting unit facing away from the bending press.

A disadvantage of the known embodiments which are controlled by means of linear drives is that there is a relatively high center of gravity of the whole rear stop device. In this way dynamic traversing movements or accelerations apply high forces on the drive units. DE 697 22 935 T2 solves this kinematic disadvantage by the said shearing lift, but has the disadvantage however that the shearing lift needs a lot of space and is limited in its stopping options. Therefore, it is not possible to achieve a space-saving installation in a metal sheet processing system, if the stop fingers need to have a traversing area that is as large as possible. Because of the limited positionability of the stop finger in stop direction there are only limited options for processing differently shaped metal sheets, or a very large amount of space is required. A further disadvantage is that the stop fingers can only be aligned in a horizontal direction. In this way the application is limited to flat metal sheets that are not prebent. The significant disadvantage of this is that the rear stop device is not adjusted to the required, free positionability in space which is necessary in modern processing machines.

SUMMARY OF THE INVENTION

The underlying objective of the present invention is to improve a rear stop device for connecting to a metal sheet processing machine, in particular a bending machine, such that the latter can be configured advantageously relative to its moved masses and also uses the available space as effectively as possible in order to achieve a large variability of possible positions.

Said objective of the invention is achieved by the features described herein. In particular, the free positionability of the bearing arm by means of the linear displacement of a support arm and the rotary slider joint required for this are important, because of the possibility of an inverse position, in which the bearing arm, which mounts a stop element, is not turned in the direction of the bending press, but points to the side facing away from the bearing press, and thus uses the available space as effectively as possible.

According to the invention a rear stop device is designed with a stop and/or gripping and/or measuring element, which is arranged by means of a pivot joint on an adjustable bearing arm. Said rear stop device is used for positioning a metal sheet to be processed on a bending press. The bearing arm is connected by means of an additional pivot joint to a guiding element, which engages in a guide rail. Furthermore, a support arm is provided which is connected by a hinge to the bearing arm and by a rigid connection to an additional guiding element. Said additional guiding element engages like the first guiding element of the bearing arm in the guide rail. The hinge connecting the bearing arm and the support arm is designed here as a rotary slider hinge. Thus the position of the bearing arm can be adjusted by a linear displacement of the rigid support arm, along a guiding direction provided by the guide rail.

An advantage of the embodiment according to the invention is that by designing the rear stop device by means of two hinge connected arms the position of the latter can be controlled by drives which are arranged in the lower guide rail. With this arrangement of the drives it is ensured that no large moved masses are arranged a large distance from the machine frame, and are thus arranged relative to the guiding and drive unit. In this way in the adjusting process of the stop and/or gripping and/or measuring element high accelerations can also be achieved with comparatively low power drives, whereby a high adjusting speed and therefore short cycle times can be achieved. By making it possible because of the complex arrangement of the individual elements and joints, to place the bearing arm in inverse position, there is a huge advantage that also very long metal sheets can be struck lightly without having to design the rear stop device to be disproportionally large.

It can be advantageous if the pivot joint between the stop and/or gripping and/or measuring element and bearing arm is designed as a rotary drive, such as for example as a servomotor. By means of this design as a rotary drive any angle $\alpha$ can be variably adjusted between the stop and/or gripping and/or measuring element and an X axis in the rotary drive perpendicular to a working plane of the bending press. Furthermore, by means of the free adjustability of the rotary angle of a stop and/or gripping and/or measuring element the greatest possible application freedom of the rear stop device is ensured. Thus for example not only a straight metal sheet can be struck but also a metal sheet that already has a bending point, and is therefore not aligned horizontally in the stop area. For example a gripping element can carry the metal sheet actively in the bending process by means of the free adjustability of the rotary angle or change the tool on the bending press and transfer it to a tool store.

Alternatively, it is possible that with the pivot joint a parallel kinematic engaging with the stop and/or gripping and/or measuring element is formed, e.g. by a rod assembly or pulling mechanism drive, so that the angle α between the stop and/or gripping and/or measuring element and the X axis is always the same regardless of the position of the bearing arm. It is an advantage in such an embodiment that on the one hand the moved masses can be reduced again and on the other hand the rear stop device can be produced inexpensively.

Furthermore, it can be advantageous if the stop and/or gripping and/or measuring element is mounted by a quick-change device on the pivot joint and/or comprises at least one stop finger.

It is ensured by means of the quick-change device that the fitting times for mounting the various different aforementioned tools which can be attached to the stop unit, can be kept as short as possible and therefore additional machine times are kept as short as possible. This reduction of the additional machine times has a positive effect on the productivity of the machine and therefore also a positive effect on the operating costs of the machine. It can be advantageous in this case that the stop finger is mounted either as a separate stop unit in order to ensure the greatest possible freedom of use in the stop position or the stop finger is for example part of the gripping or measuring tool, in order to avoid a tool change between the individual processing stages. Furthermore, it is also possible that a plurality of stop fingers are mounted in the form of a tool revolver on the periphery in order to use different stop finger geometries.

Furthermore, it can be advantageous if a measuring unit detects a rotary moment, which is introduced by a force exerted at a distance from the rotary axis and perpendicular to the stop finger. By detecting the rotary moment in specific positions of the stop finger, the stopping force exerted on the stop finger can be detected. With the use of a gripping element for actively guiding the metal sheet to be bent by means of the rotary moment a deviation of the actual position of the metal sheet from the desired position can be identified. Furthermore, a collision of the stop and/or gripping and/or measuring element with an object can be detected, whereby also the personal safety can be increased as it is possible to prevent squeezing by detection. A further advantage is that during a bending tool change any possible jamming of the bending tool can be detected.

An embodiment is also advantageous in which the stop finger comprises a plurality of stop surfaces, which can be determined or actively predefined with respect to their position and location by a control device. It is possible in this way that the stop finger can be used not only, as with a conventional stop finger, as a stop for a straight metal sheet, but also so that angled and already bent metal sheets can be positioned by the stop finger, in that the alignment of the stop finger is changed and one of the additional stop surfaces is used for positioning. The dimensions of bending sequences can also be made more precise in this way.

Furthermore, it is possible for the stop finger to have a step-like shoulder, whereby two stop surfaces are formed which are at right angles to one another. It is an advantage in this case that the metal sheet can be positioned on a stop surface in horizontal position and at the same time the metal sheet is supported by the horizontal stop surface standing thereon at right angles, in order to prevent the bending of the metal sheet by the action of gravity.

An embodiment is also advantageous in which the guide rail has separate, parallel guiding surfaces for the guiding elements of the bearing arm and the support arm. In this way a drive of the two guiding elements can be converted in that the latter can be moved independently of one another.

According to an advantageous development it is possible that the guiding element of the support arm and the guiding element of the bearing arm can be displaced on the common guide rail independently of one another by two mechanical adjusting drives in guiding direction. By means of this independent adjusting option of the two guiding elements a length and height positioning of the stop and/or gripping and/or measuring element can be achieved by the position of the bearing arm and the support arm relative to one another. By means of the mutually independent drives it is also possible that the guiding elements can be moved past one another and therefore an inverse position is possible.

In an alternative embodiment it is possible that the guiding element of the bearing arm or the guiding element of the support arm can be displaced by a mechanical main adjusting drive in guiding direction, whereby it becomes a main guiding element and that the guiding element of the respective other arm is coupled to the main guiding element by an additional mechanical adjusting drive movable relative to the main guiding element. It can be advantageous here that in the case of a purely longitudinal displacement of the rear stop only the drive of the main guiding element has to be moved and the drive of the second guiding element, dependent on the main guiding element, need not be controlled. In this case it is possible that the second drive is exposed to lower levels of wear and energy can be saved during the adjusting movement.

Furthermore, it is possible that the guiding direction of the guide rail is arranged in the direction of the X axis or in a vertical direction, or in a Z direction perpendicular to the X direction and the R direction. The arrangement in X direction represents a stopping option similar to conventional rear stop devices. In an alternative arrangement in R direction, it can be advantageous that the space requirements behind the bending machine are not limited by the stop device. In an arrangement in Z direction it can be advantageous that the kinematic conditions can be improved further.

It is also advantageous if the guide rail can be positioned by means of a positioning drive optionally in Z direction, or in R direction. In this way the rear stop device can also be positioned freely in a direction parallel to the bending line, whereby metal sheets of different sizes and forms can be processed.

An advantageous embodiment can be achieved if the length x of the support arm is between 5% and 90%, preferably between 40% and 60% of the length y of the bearing arm. In this way it is ensured that the required height adjustment of the stop and/or gripping and/or measuring element is ensured by an adjustment movement of the guiding elements to one another and thereby it is not necessary to have adjusting forces and adjusting paths that are too high. The bearing arm and support arm together form a support structure for the stop and/or gripping and/or measuring element, which is similar to the Greek letter lambda λ, wherein the bearing arm corresponds to the longer straight section which is supported by the shorter straight section in the form of the support arm.

According to a particular embodiment it is possible that the length y1 of the bearing arm between the rotary drive and the pivot joint, which connects the bearing arm to the support arm, can be adjusted variably by means of a length adjusting drive. In this way metal sheets of various different shapes and length can be processed.

BRIEF DESCRIPTION OF THE DRAWINGS

For a better understanding of the invention the latter is explained in more detail with reference to the following Figures.

In a schematically much simplified representation.

DETAILED DESCRIPTION OF THE REFERRED EMBODIMENTS

Figure 1:
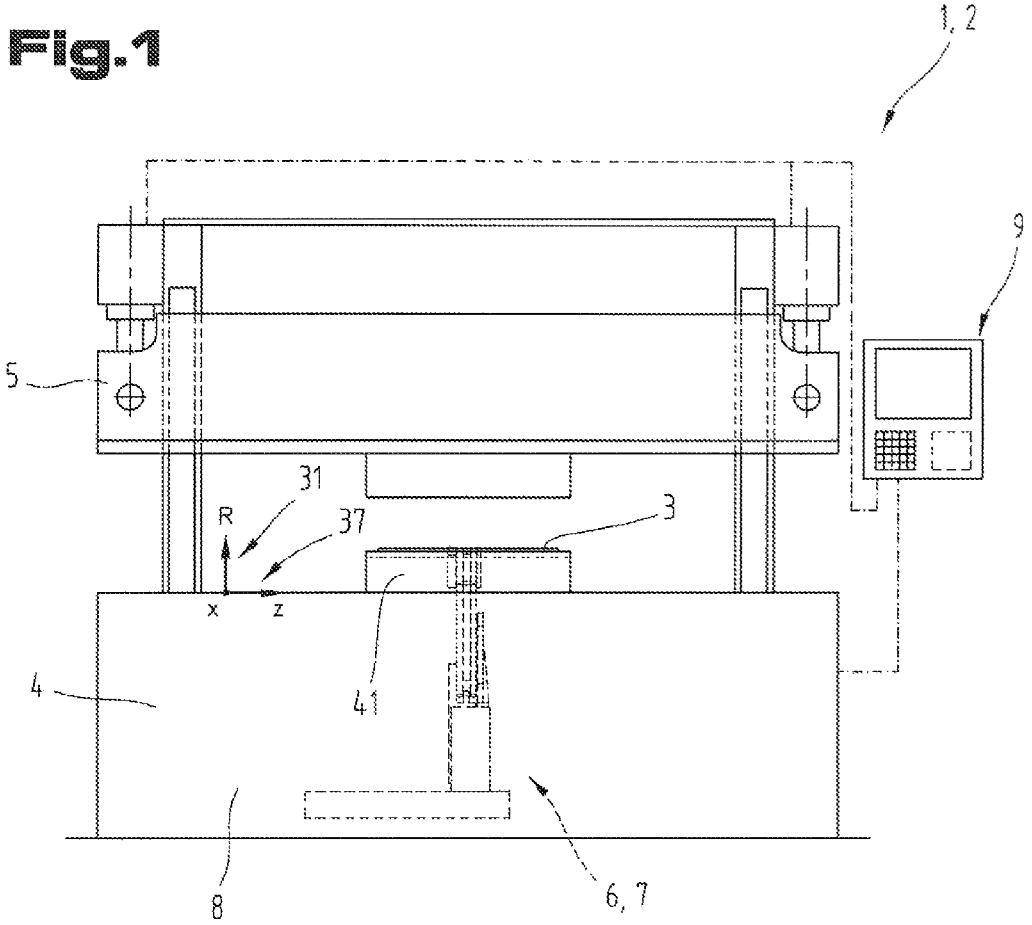
FIG. 1 is a front view of a sheet metal processing machine for bending sheet metal including the rear stop device.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIG. 1 shows a processing machine 1 comprising a bending press 2, in particular for bending a metal sheet 3, with a fixed pressing bar 4 and a pressing bar 5 adjustable relative to the latter. The processing machine 1 also comprises a rear stop device 6, which consists of at least one rear stop device 7. The rear stop device 7 is mounted in the shown example embodiment on the machine frame 8. However, it is not absolutely necessary for the rear stop device 7 to be mounted directly on the machine frame 8. An embodiment is also possible in which the rear stop device 7 is attached at the machine site as a separate unit directly to a shop floor and is not fitted onto the machine frame 8. In this case after the assembly the rear stop device 7 would have to be gauged precisely to the machine frame 8. To meet the requirements for precision of the metal sheet 3 to be bent it is practical however, if the rear stop device 7 is mounted directly on the machine frame 8.

A control device 9 is also attached directly onto the machine frame 8 which is responsible for controlling the bending press 2 and the rear stop device 6. For controlling the rear stop device 6 it is possible that the latter has its own control unit which is connected to the control device 9 of the processing machine 1 by a bus system. A preferred variant however is one in which the actuators of the rear stop device 6 can be controlled in their movement directly by the control device 9 of the processing machine 1.

Figure 2:
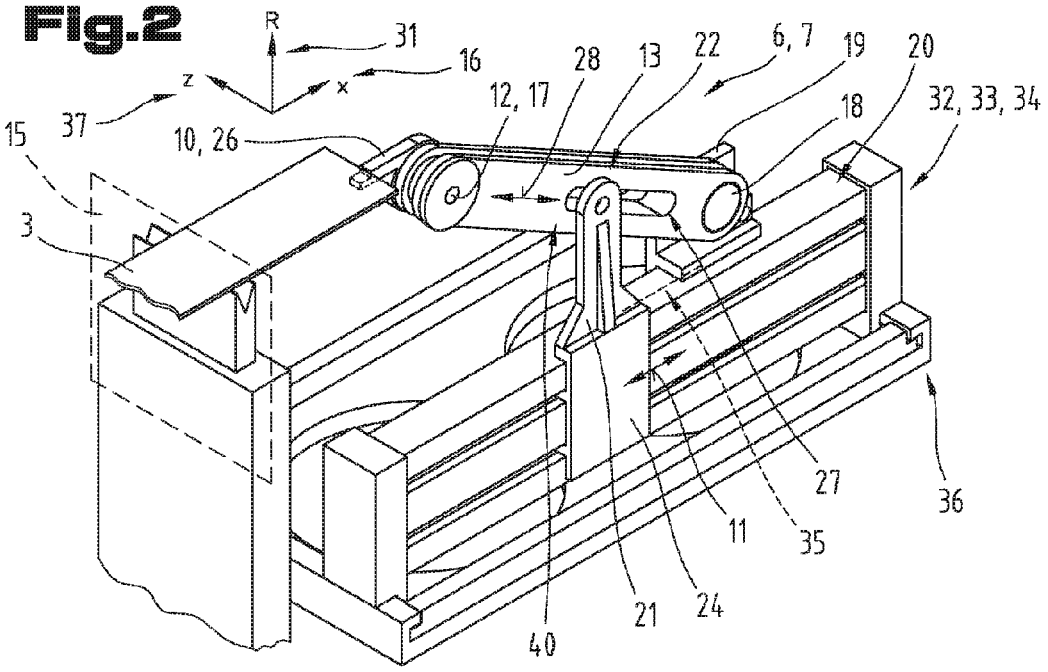
FIG. 2 is a perspective view of a rear stop device.
Figure 3:
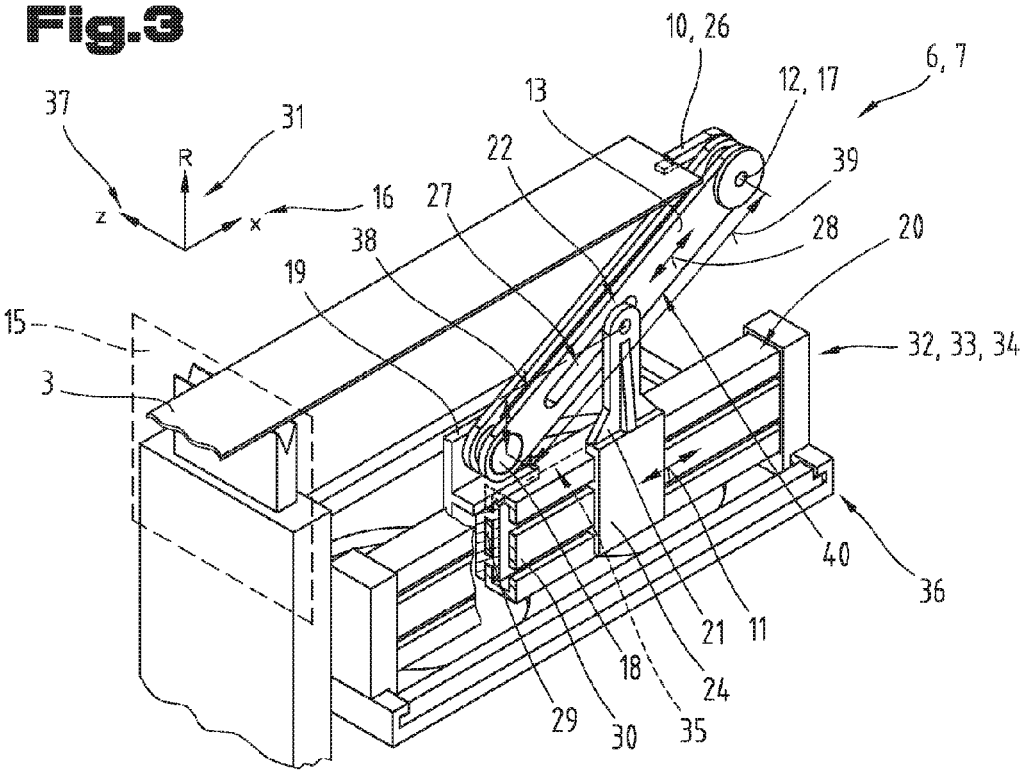
FIG. 3 is a perspective view of a rear stop device in an inverse position.

As shown in FIGS. 2 and 3, the rear stop device 7 comprises a stop and/or gripping and/or measuring element 10. Said stop and/or gripping and/or measuring element 10 is responsible for the correct positioning of the metal sheet 3 and during the positioning process are in direct contact with the metal sheet 3. As a stop and/or gripping and/or measuring element 10 different elements can be used which are described in more detail below.

An essential advantage of the invention is an embodiment in which the stop and/or gripping and/or measuring element 10 is connected by means of a pivot joint 12 to the bearing arm 13. It is ensured by means of this pivot joint 12 that an angle $\alpha$ 14, between an X axis 16 perpendicular to the working plane 15 of the bending press 2 and the stop and/or gripping and/or measuring element 10 can be freely selected and adjusted. The free adjustment of the angle $\alpha$ 14 is performed by a rotary drive 17, which is controlled by the control device 9 of the machine. The rotary drive 17 is preferably designed as a torque motor, wherein also other types of rotary drive 17 are possible, for example a belt drive with integrated position detection.

To achieve an inexpensive alternative it can also be possible for the stop and/or gripping and/or measuring element 10 to be connected by means of a pulling mechanism drive 23, or by means of a rod assembly parallel to the bearing arm 13, which are also connected to the guiding element 19, and thus ensure that the angle $\alpha$ in the stop and/or gripping and/or measuring element 10 always remain unchanged, regardless of the position of the bearing arm 13.

The guiding element 19 and the guide rail 20 are connected to one another in a form-fitting manner to enable the sliding of the guiding element 19 in a guiding direction 11 of the guide rail 20.

A support arm 21 is connected to the bearing arm 13 at one end by an additional joint 22, which is designed as a rotary slider joint. At the other end the support arm 21 is connected by a rigid connection to an additional guiding element 24.

The arrangement of the bearing arm 13 and the support arm 21 relative to one another and the joint connection 22 in the form of a rotary slider joint ensures that by moving the support arm 21 relative to the bearing arm 13, the position of the bearing arm 13 can be changed.

A quick-change device 25, which is not shown in detail but is suggested, is connected between the stop and/or gripping and/or measuring element 10 and the fixing point at the pivot joint 12. The use of a quick-change device 25 seems practical, if different tools or stop elements are used. The aim here is to enable the fastest and simplest changing of the individual tools. The quick-change device 25 can be controlled either by the control device 9 and thus enable an automatic tool change, or can be designed only for a manual tool change. The stop finger 26 which is described in more detail can either be designed as a separate stop element 10, or in combination with a gripping, or measuring element 10. It is also possible that the gripping element 10 does not have a separate stop finger 26 for example, but for the stop finger to form a part of the gripping or measuring element 10, and therefore have a double functionality.

FIG. 3 shows the inverse position of the bearing arm 13, in which the latter is not inclined towards the working plane 15, but is inclined away from the latter. By means of this movability of the bearing arm 13 also in restricted spaces in the processing machine 1 the greatest possible flexibility is ensured with regard to the stopping options of metal sheets 3 of varying lengths. Here it is essential that the bearing arm 13 has a linear guide 27 in which the rotary push joint 22 can be displaced along a longitudinal direction A 28 on the bearing arm.

The connection between the guide rail 20 and the guiding elements 19 and 24 can be designed so that the form-fitting connection between the guiding elements 19 and 24, and the guide rail 20 is performed by guiding surfaces 29, which are gripped behind by the two guiding elements 19 and 24 in the same manner. However, it is also possible that the guiding element 19 of the bearing arm 13 is connected in a form-fitting manner by the guiding surfaces 29 to the guide rail 20, and the guiding element 24 of the support arm 21 is connected by additional guiding surfaces 30 in a form-fitting manner to the guide rail. In this way it is advantageous, if the guide rail 20 has guiding surfaces 29 for the guiding element 19 and on the opposite side of the guide rail 20 has additional guiding surfaces 30 for the other guiding element 24. By means of a separate guiding of the guiding elements 19, 24 in the guide rail 20 it is possible that the guiding elements 19, 24 can be displaced independently of one another by two mechanical adjusting drives 32 and 33 in guiding direction 11. It can also be seen to be advantageous if the guiding elements 19 and 24 can be moved past one another in guiding direction 11 on the guide rail 20. The adjusting drives 32 and 33 can be designed for example as spindles, into which the guiding elements 19 and 24 engage which then had to have a ball joint drive. It is also possible that the adjusting drives 32 and 33 are formed for example by gear wheels which engage in the guide rail and thus enable an adjustment of the guiding elements 19, 24. It is also possible that the guiding elements 19, 24 are adjusted by a pulling means which is secured to the guiding elements 19, 24, or but also however that the guiding elements 19, 24 are positioned by a direct drive in the form of a linear magnetic drive. The drives for the different, shown embodiments can be arranged either directly on the guiding elements 19, 24, or can also be integrated into the machine frame 8. However, it is also possible that the guiding elements 19, 24 cannot be positioned individually and independently of one another in their position, but one of the guiding elements 19, 24 can be displaced by a mechanical main adjusting drive 34 in guiding direction 11, whereby it becomes a main guiding element, and that the respective other guiding element 19, 24 is coupled by an additional, mechanical adjusting drive 35, movably relative to the main guiding element 19, 24. In this way the main guiding element can be adjusted by one of the aforementioned adjusting drives and the additional guiding element 19, 24 can only be adjusted relative to the main guiding element 19, 24, which has the advantage that during adjusting processes of the stop finger 26, which only pass along an X direction 16, there is no need to adjust the other respective guiding element 19, 24. The adjustment of the other guiding element 19, 24 is performed by the mechanical coupling to the main guiding element 19, 24, whereby the guiding elements are thereby displaced jointly with one another.

The guide rail 20 as a whole can be arranged so that the guiding direction 11 of the guide rail is arranged either in X direction 16 or in a vertical R direction 31. Said arrangements can ensure that the limited space between the bending press 2 can be used optimally. Furthermore, it is possible that the guide rail 20 can be positioned by means of a positioning drive 36 in a Z-direction 37 which is perpendicular to the X direction 16 and the R direction 31. The positioning drive 36 can be designed hereby in Z direction 37, as in the above examples of the positioning drives 32, 33 in different variants.

The geometries of the support arm 21 and the bearing arm 13 can be configured in any way, however, to make optimal use of the space, it seems practical for the length x 38 of the support arm 21 to be between 5 and 90%, preferably between 40% and 60% of the length y 39 of the bearing arm 13. The bearing arm 13 and support arm 21 together form a supporting structure for the stop and/or gripping and/or measuring element 10, which is similar to the Greek letter lambda λ, whereby the bearing arm 13 corresponds to the longer straight section, which is supported by the shorter straight section in the form of the support arm 21. Further adjusting options are provided if the length y 39 of the bearing arm 13 can be adjusted variably between the rotary drive 17 and pivot joint 22 by means of a length adjusting drive 40. The length adjusting drive hereby changes the length y 39 of the bearing arm 13 in longitudinal direction A 29.

Figure 4:
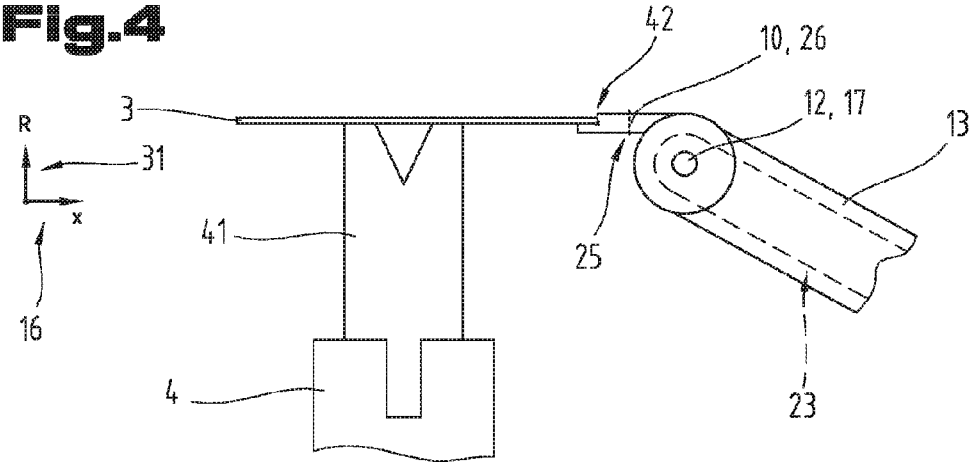
FIG. 4 is an example of stopping options for positioning a flat metal sheet; detail of a stop finger.
Figure 6:
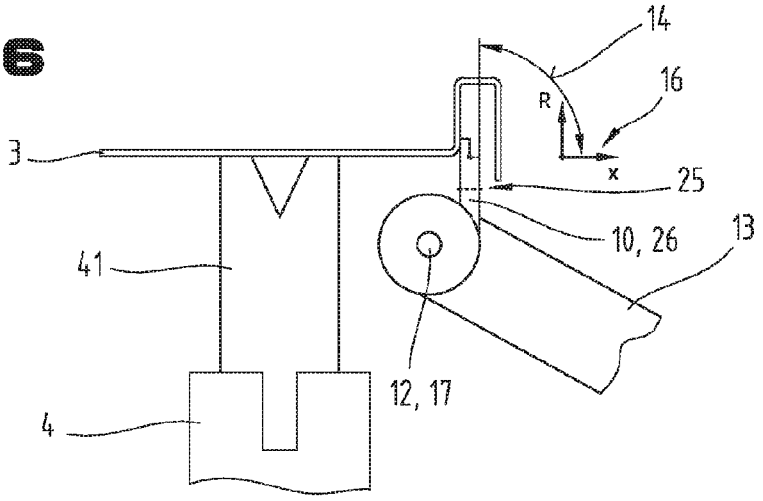
FIG. 6 is an example of stopping options for positioning the prebent metal sheet; detail of stop finger.
Figure 7:
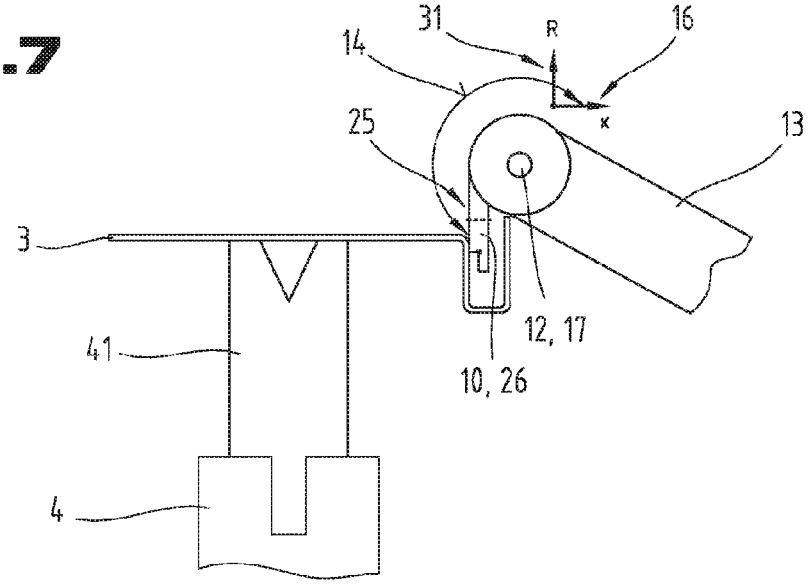
FIG. 7 is an example of additional stopping options for positioning a prebent metal sheet; detail of a stop finger.

FIG. 4, FIG. 6 and FIG. 7 show further examples of stopping options for the stop and/or gripping and/or measuring element 10. FIG. 4 shows a conventional stopping option in which the metal sheet 3 bears horizontally on a bending tool 41 mounted on the fixed pressing bar 4, and is stopped in horizontal direction against a stop finger 26. In this case it is an advantage, if the stop finger 26 has a step-like shoulder 42, whereby two mutually right-angled stop surfaces 43, 44 are formed, by means of which the metal sheet 3 can be positioned in X direction 16 and at the same time in R direction 31 the metal sheet 3 is supported against a possible bending due to gravity.

Figure 5:
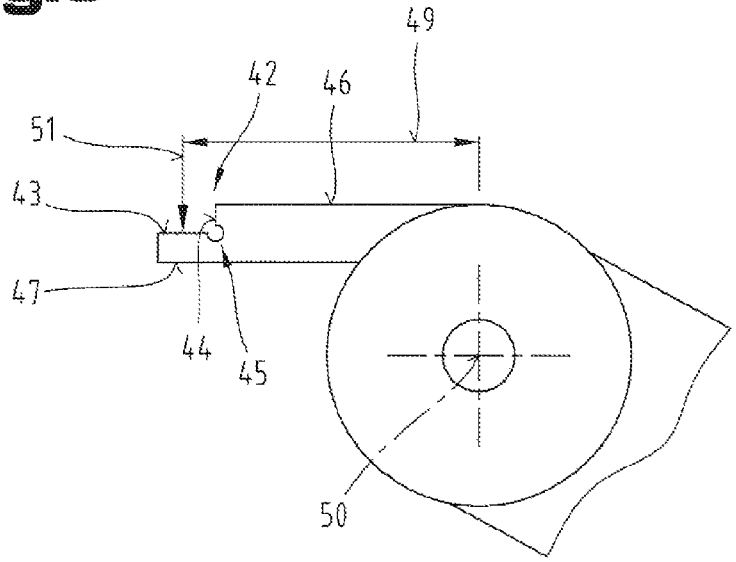
FIG. 5 is a detail of stop finger.

FIG. 5 shows a detail of the stop finger, in which the two stop surfaces 43 and 44 are separated by a space 45, so that a possible bead or ridge in the metal sheet 3 caused by cutting does not cause a positioning error. It is an advantage if the stop finger 26 not only comprises said two stop surfaces 43 and 44, but if also additional surfaces are formed as stop surfaces 46, 47, the position of which can be determined or actively defined by the control device 9. By means of the additional stop surfaces 46, 47 additional stop options are provided, as shown in FIG. 6 and FIG. 7. For a stop as shown in FIG. 4, FIG. 6 or FIG. 7, it can be an advantage if a measuring unit 48 determines a rotary moment, which is introduced by a force at a distance A 49 from a rotary axis 50 of the pivot joint 12. The rotary moment can also be detected by a monitoring device of the motor current in the torque motor.

The example embodiments show a possible embodiment variant of the processing machine 1 or the rear stop device 6, wherein it should be noted at this point that the invention is not limited to the embodiment variants thereof shown in particular.

Finally, as a point of formality, it should be noted that for a better understanding of the structure of the processing machine 1 and the rear stop device 6 the latter and its components have not been represented true to scale in part and/or have been enlarged and/or reduced in size.

The underlying objective of the independent solutions according to the invention can be taken from the description.

Mainly the individual embodiments shown in FIGS. 1 to 7 can form the subject matter of independent solutions according to the invention. The objectives and solutions according to the invention relating thereto can be taken from the detailed descriptions of these figures.

| List of reference numerals | |
|---|---|
| 1 | processing machine |
| 2 | bending press |
| 3 | metal sheet |
| 4 | fixed pressing bar |
| 5 | adjustable pressing bar |
| 6 | rear stop device |
| 7 | rear stop unit |
| 8 | machine frame |
| 9 | control device |
| 10 | stop and/or gripping and/or measuring element |
| 11 | guiding direction |
| 12 | pivot joint |
| 13 | bearing arm |
| 14 | angle α |
| 15 | working plane |
| 16 | X axis |
| 17 | rotary drive |
| 18 | pivot joint |
| 19 | guiding element |
| 20 | guide rail |
| 21 | support arm |
| 22 | pivot joint |
| 23 | pulling mechanism drive |
| 24 | guiding element |
| 25 | quick-change device |
| 26 | stop finger |
| 27 | linear guide |
| 28 | longitudinal direction A |
| 29 | guiding surfaces |
| 30 | guiding surfaces |
| 31 | R axis |
| 32 | adjusting drive |
| 33 | adjusting drive |
| 34 | main adjusting drive |
| 35 | adjusting drive |
| 36 | positioning drive |
| 37 | Z axis |
| 38 | length x |
| 39 | length y |
| 40 | length adjusting drive |
| 41 | bending tool |
| 42 | step-like shoulder |
| 43 | stop surface |
| 44 | stop surface |
| 45 | free space |
| 46 | stop surface |
| 47 | stop surface |
| 48 | measuring unit |
| 49 | distance A |
| 50 | rotary axis |
| 51 | force |

The invention claimed is:

1. A rear stop device comprising a stop element for positioning a metal sheet to be processed on a bending press, wherein the stop element is arranged via a pivot joint on an adjustable bearing arm, which adjustable bearing arm is connected via an additional pivot joint to a guiding element, and by said guiding element to a guide rail, wherein a support arm, is connected by a joint to the adjustable bearing arm, and wherein the support arm is rigidly connected to an additional guiding element, and is mounted by said additional guiding element displaceably on the guide rail, and the joint is designed as a rotary slider joint.

2. The rear stop device as claimed in claim 1, wherein the pivot joint is designed as a rotary drive, and wherein a first angle between the stop element and an X axis perpendicular to a working plane of the bending press can be variably adjusted in the rotary drive.

3. The rear stop device as claimed in claim 2, wherein in the pivot joint a parallel kinematic is formed engaging with the stop element so that the first angle is always the same regardless of the position of the bearing arm.

4. The rear stop device as claimed in claim 1, wherein the stop element is mounted by a quick release device on the pivot joint and/or comprise at least one stop finger.

5. The rear stop device as claimed in claim 4, wherein a measuring unit detects a rotary moment introduced by a force exerted at a distance from a rotary axis, of the pivot joint, and perpendicular to a stop surface of the stop finger.

6. The rear stop device as claimed in claim 4, wherein the top finger comprises a plurality of stop surfaces, and wherein a control device is configured to control a position and location of the plurality of stop surfaces.

7. The rear stop device as claimed in claim 4, wherein the stop finger has a step-like shoulder comprising two stop surfaces formed at right angles to one another.

8. The rear stop device as claimed in claim 1, wherein the guide rail has separate guiding surfaces for mounting the guiding element and the additional guiding element.

9. The rear stop device as claimed in claim 1, wherein the additional guiding element and the guiding element can be displaced on the guide rail in a guiding direction independently of one another via two mechanical adjusting drives.

10. The rear stop device as claimed in claim 1, wherein the guiding element or the additional guiding element can be displaced in a guiding direction via a mechanical main adjusting drive such that the guiding element or the additional guiding element becomes a main guiding element, and wherein the other of the guiding element and the additional guiding element is coupled to the main guiding element by an additional mechanical adjusting drive to be movable relative to the main guiding element.

11. The rear stop device as claimed in claim 1, wherein a guiding direction of the guile rail is arranged in a direction of an X axis or in a vertically upright direction or in a Z direction perpendicular to the X axis and the vertically upright direction.

12. The rear stop device as claimed in claim 11, wherein the guide rail can be positioned via a positioning drive in the Z direction or in the vertically upright direction.

13. The rear stop device as claimed in claim 1, wherein a length of the support arm is between 5 and 90% of a length of the bearing arm.

14. The rear stop device as claimed in claim 1, wherein a length of the bearing arm between the rotary drive and the joint can be adjusted variably via a length adjusting drive.

15. A processing machine comprising a bending press, with a fixed pressing bar and a pressing bar adjustable relative to the latter and a rear stop unit, wherein the rear stop unit comprises at least one rear stop device as claimed in claimed 1.

* * * * *